US005983594A

United States Patent [19]

Forman

[11] Patent Number: 5,983,594

[45] Date of Patent: Nov. 16, 1999

[54] ADHESIVELY RESEALABLE PACKAGE, METHOD AND APPARATUS

[76] Inventor: Harold M Forman, P.O. Box 60, Boyertown, Pa. 19512

[21] Appl. No.: 08/916,322

[22] Filed: Aug. 22, 1997

[51] Int. Cl.[6] ..... B65B 61/20

[52] U.S. Cl. ..... 53/133.5; 53/133.4; 53/139.2; 383/210; 383/211

[58] Field of Search ..... 53/412, 133.8, 53/133.5, 139.2, 133.4; 383/200, 203, 207, 208, 210, 211

[56] References Cited

U.S. PATENT DOCUMENTS

| | | | |
|---|---|---|---|
| 4,364,478 | 12/1982 | Tuns | 53/412 |
| 4,651,874 | 3/1987 | Nakamura | 383/208 |
| 4,785,940 | 11/1988 | Wilson | 383/211 |
| 4,786,190 | 11/1988 | Van Erden et al. | 383/207 |
| 5,512,337 | 4/1996 | Littmann et al. | 53/412 |
| 5,519,982 | 5/1996 | Herber et al. | 53/412 |
| 5,551,781 | 9/1996 | Wilkes et al. | 383/200 |

FOREIGN PATENT DOCUMENTS

| | | | |
|---|---|---|---|
| 400826 | 12/1990 | European Pat. Off. | 383/211 |
| 6191522 | 7/1994 | Japan | 53/133.5 |

*Primary Examiner*—Eugene L. Kim
*Attorney, Agent, or Firm*—Walter B. Udell

[57] ABSTRACT

The package and system according to the invention utilize a novel converter device mounted adjacent to standard packaging apparatus for forming a composite packaging film and feeding it to the packaging apparatus to form a finished package with an adhesively resealable closure structure oriented in the consumer desired direction extending transversely to the long dimension of the package. Alternatively, the composite packaging film made according to the invention may be wound on a spool and stored for future use if there is a substantial difference between the rate of production of the composite packaging film and the production rate of the packaging machinery. The converter and the composite film made by it function with both horizontal and vertical form/fill/seal wrapping machines and with overwrap packagers. The composite packaging film is formed by the converter by unwinding the plastic packaging film from a storage roll where the film is first transversely slotted at package length intervals and then has a strip from the roll of adhesively coated film pressed onto it covering and overlapping the previously cut slot, the composite film being then either transported into a packaging machine where product packaging takes place, or being wound onto a takeup roll for future use. The converter apparatus includes computer controlled timing devices to properly time and coordinate the slotting of the film and the applying of the adhesively coated film strip thereto, as well as holding and then removing the slotted out pieces of film, and slitting strips of the adhesively coated film from its supply roll. A variety of packaging films may be used, such as polypropylene, polyester, polyvinyl chloride, high and medium density polyethylene, and various film laminations.

2 Claims, 7 Drawing Sheets

FIG.1
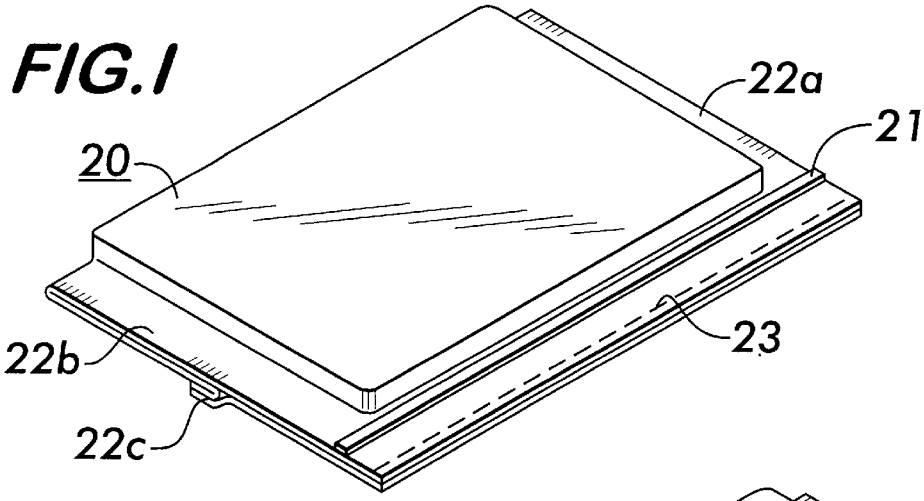
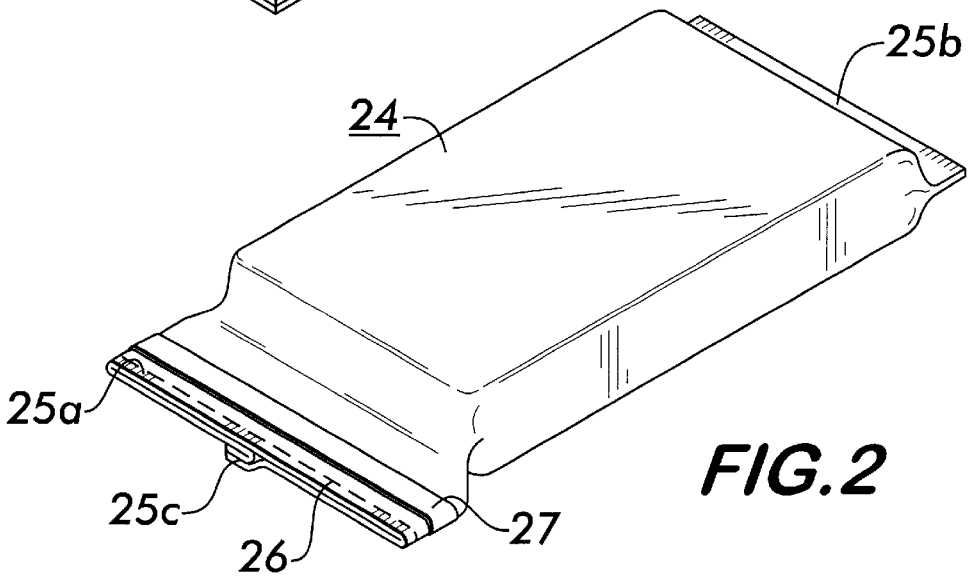
FIG.2
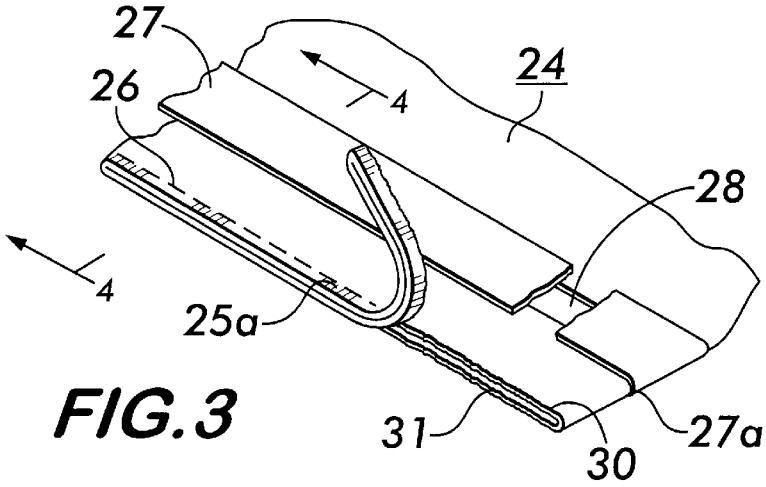
FIG.3

FIG.4
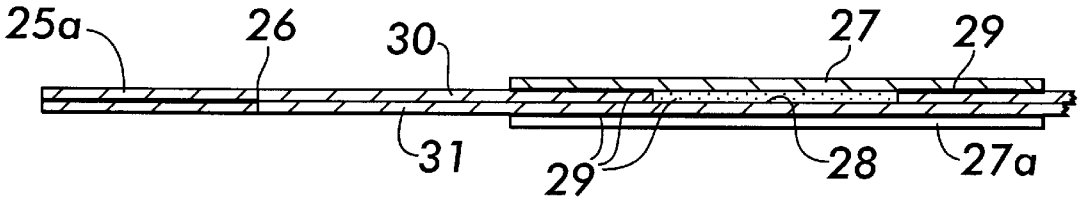
FIG.5
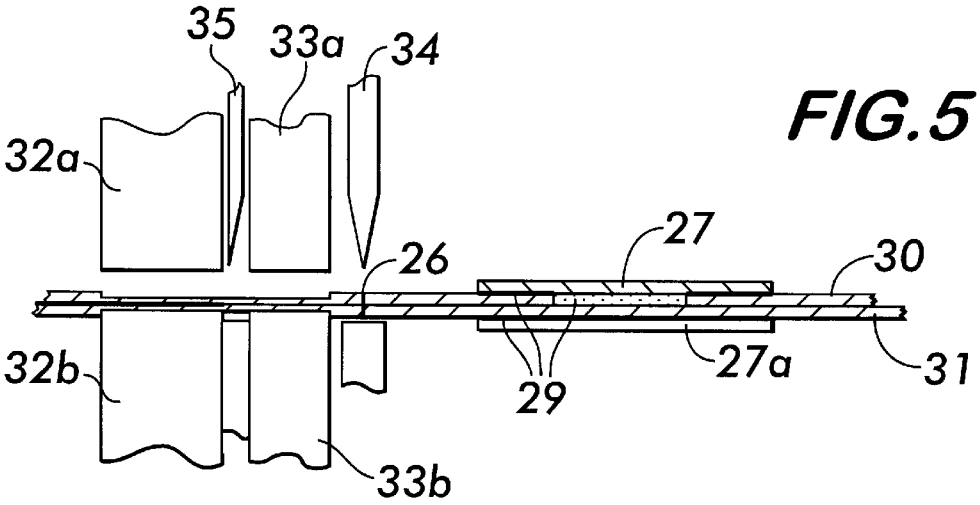
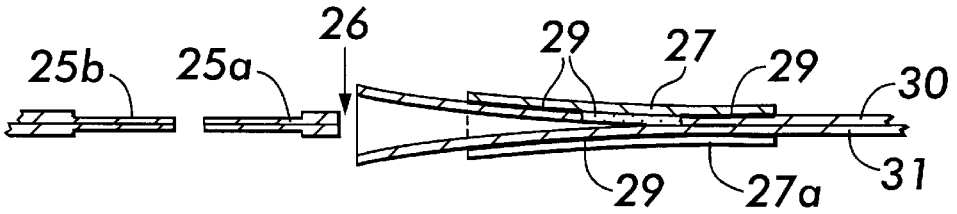
FIG.6

49
56
50a
48
59
65
50
52
60
60
51
41
61
67
66
53
68
54
38
55
69

ADHESIVELY RESEALABLE PACKAGE, METHOD AND APPARATUS

BACKGROUND OF THE INVENTION

1. Field of the Invention

This invention relates generally to packaging systems, and more particularly to flexible packages having an openable and adhesively resealable closure and a method and apparatus for making the same from separate rolls of preprinted flexible packaging film and adhesively coated film which form a composite packaging film, the closure being formed transversely to the direction of packaging film flow at the consumer preferred position across one end of the package.

2. Related Art

In the past, the methods of making reclosable flexible packages have involved the positioning of the package resealing structure extending longitudinally in the running direction of the packaging film along the long edge of the finished package in the consumer non-preferred position.

SUMMARY OF THE INVENTION

The package and system according to the invention may utilize a novel converter device mounted adjacent to standard packaging apparatus for forming the composite packaging film and feeding it to the packaging apparatus to form a finished package with an adhesively resealable closure structure oriented in the consumer desired direction extending transversely to the long dimension of the package. Alternatively, the composite packaging film made according to the invention may be wound on a spool and stored for future use, particularly if there is a substantial difference between the rate of production of the composite packaging film and the package forming rate. The converter and the composite film made by it function with both horizontal and vertical form/fill/seal wrapping machines and with overwrap packagers.

The composite packaging film is formed by the converter by unwinding the plastic packaging film from a storage roll where the film is first transversely slotted at package length intervals and then has a strip from the roll of adhesively coated film pressed onto it covering and overlapping the previously cut slot, the composite film being then either transported into a packaging machine where product packaging takes place, or being wound onto a takeup roll for future use. The converter apparatus includes computer controlled timing devices to properly time and coordinate the slotting of the film and the applying of the adhesively coated film strip thereto, as well as holding and then removing the slotted out pieces of film, and slitting strips of the adhesively coated film from Its supply roll. A variety of packaging films may be used, such as polypropylene, polyester, polyvinyl chloride, high and medium density polyethylene, and various film laminations.

Accordingly, it is a primary object of the invention to provide a novel flexible package having an openable and adhesively resealable closure.

Another object of the invention is to provide a novel flexible package having an openable and adhesively resealable closure in which the closure is formed transversely to the direction of film flow at the consumer preferred position across one end of the package.

A still further object of the invention is to provide novel packages as aforesaid in which the packages may be formed from a variety of packaging films such as polypropylene, polyester, polyvinyl chloride, high and medium density polyethylene, and various film laminations.

An additional object of the invention is to provide novel methods and apparatus for making packages and composite packaging film according to the invention.

The foregoing and other objects of the invention will be more clearly understood from a reading of the following description in conjunction with an examination of the appended drawings.

BRIEF DESCRIPTION OF THE DRAWINGS

FIG. 1 is an isometric view of a prior art package showing the resealable package feature extending along the long side of the package in the consumer non-preferred position;

FIG. 2 is an isometric view of a package according to the invention showing the package end seals and the consumer preferred transversely extending resealable feature;

FIG. 3 is an enlarged isometric fragmentary view of a corner of the package according to the invention showing the package opening tearstrip and the resealable strip sectioned to show the underlying slotted opening in the package film;

FIG. 4 is an enlarged cross sectional view through the resealable closure, package opening perforation feature, and package end seal as would be seen when viewed along the line 4—4 on FIG. 3;

FIG. 5 is a detail view showing the severing of adjacent completed packages and the formation of the perforation package opening feature by the packaging apparatus;

FIG. 6 is a cross sectional view similar to that of FIG. 5 showing the separated packages, the package opening perforations in opened position, and the package partly unsealed by partial separation of the resealing strip from the underlying package film;

In the several figures, like elements are denoted by like reference characters.

DESCRIPTION OF THE PREFERRED EMBODIMENT

Figure 7:
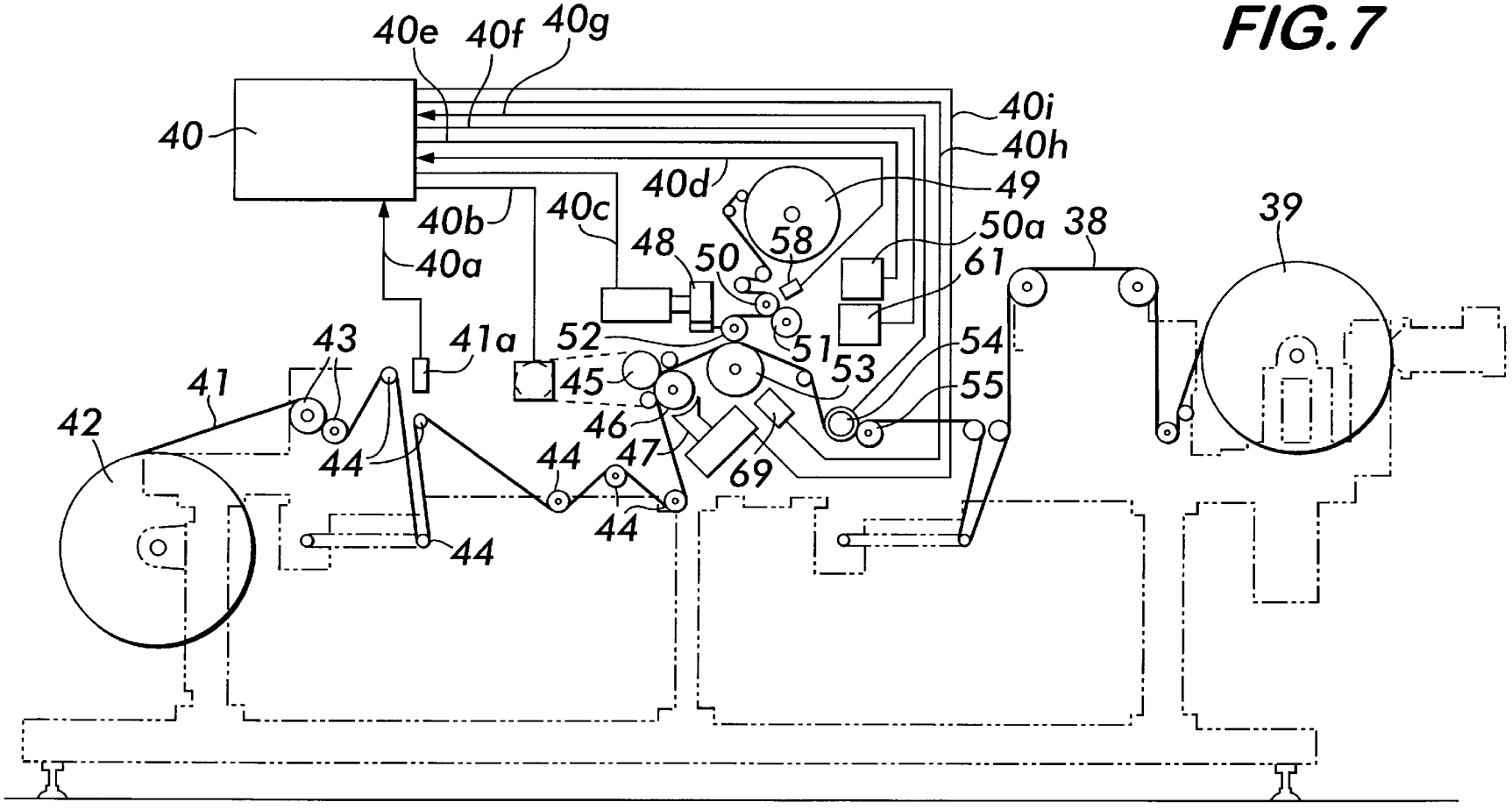
FIG. 7 is a side diagrammatic view of the converter apparatus according to the invention showing the stages of formation of the composite film from start to finished take-up roll.
Figure 8:
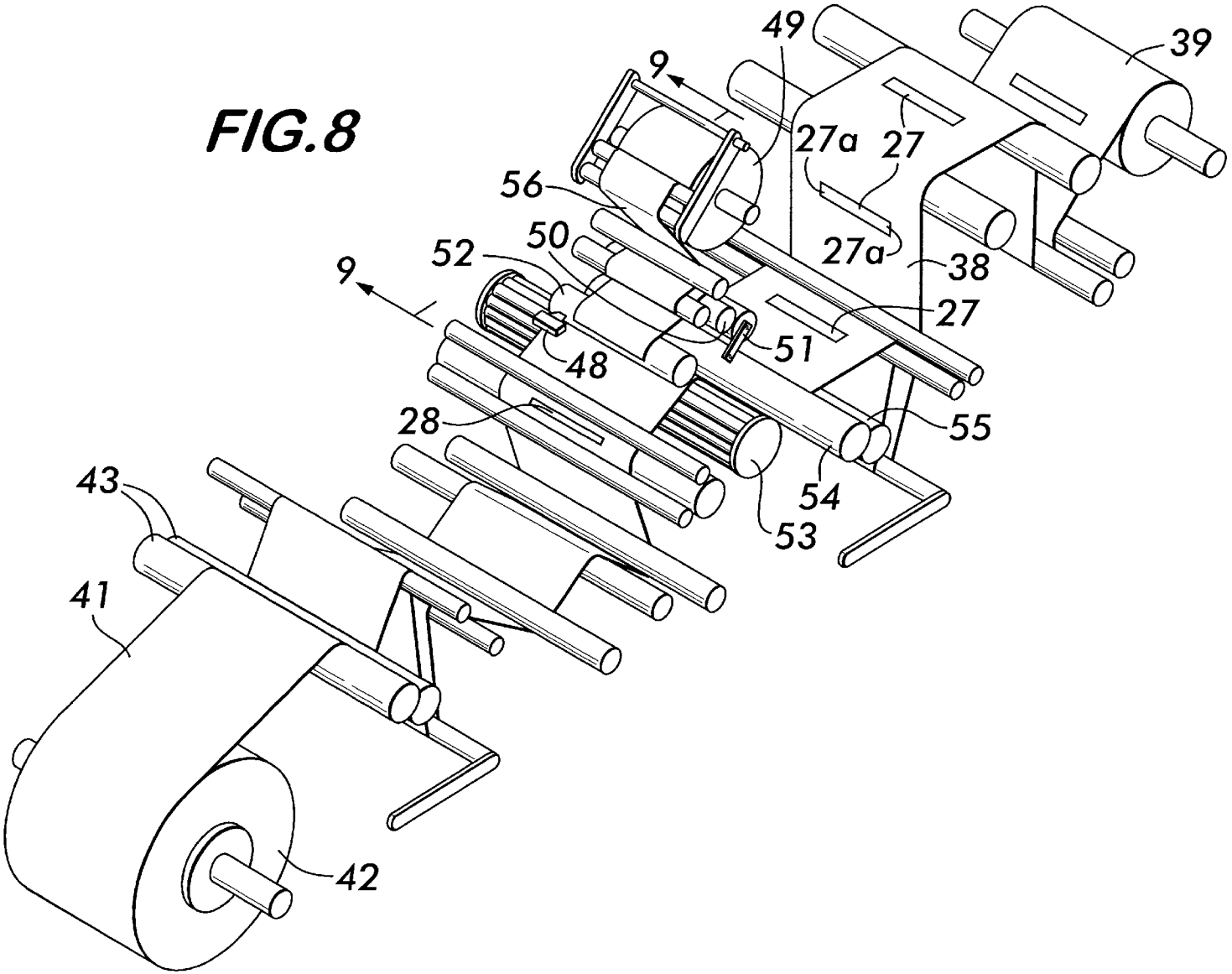
FIG. 8 is an isometric diagrammatic view from above of the apparatus of FIG. 7 with some parts removed for clarity.
Figure 9:
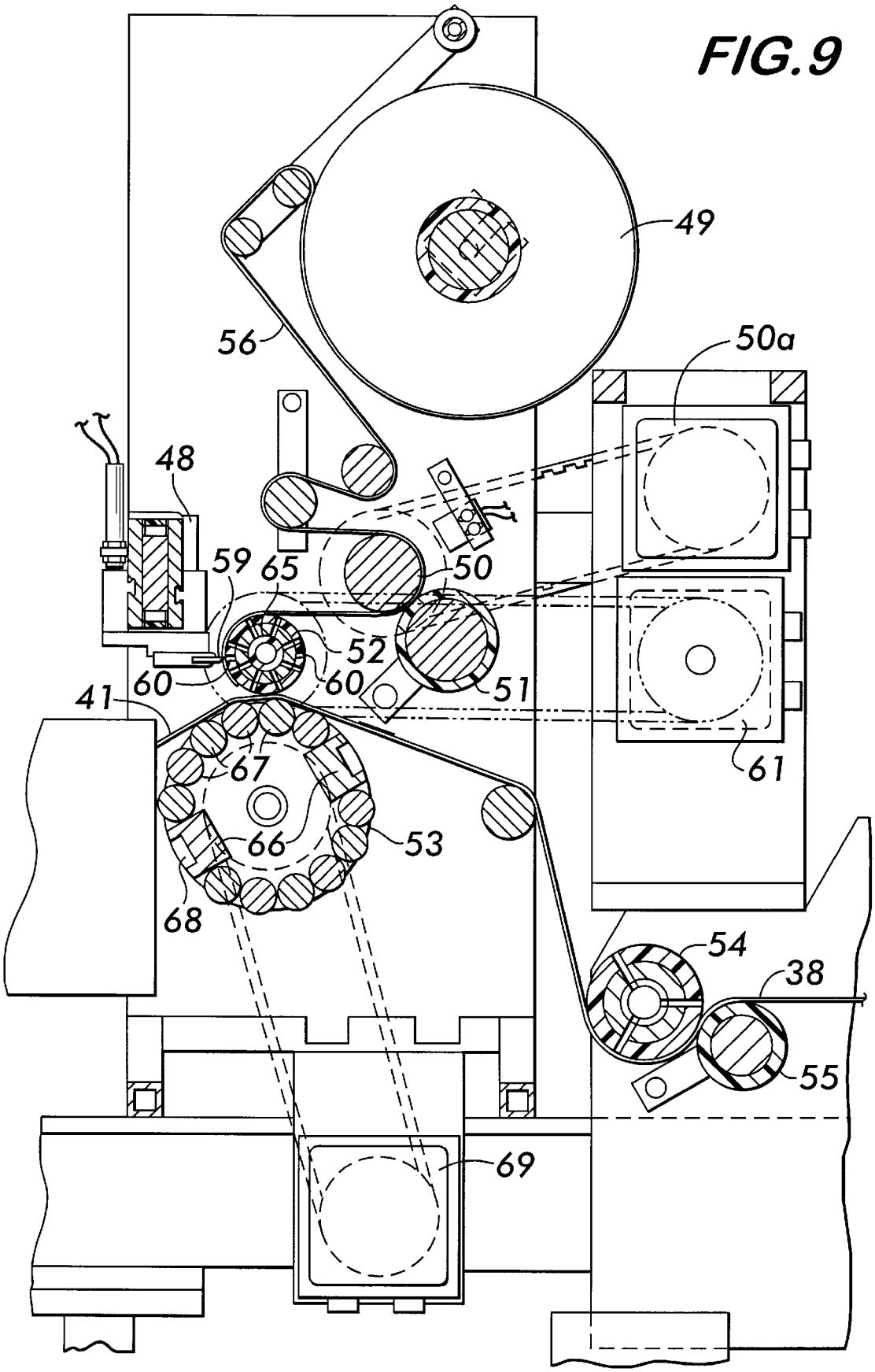
FIG. 9 is an enlarged view of the central section of the apparatus of FIG. 7 to more clearly show the slitting of the adhesive strip from its roll and its application to the film.

FIG. 1 shows a typical prior art package 20 having the resealable package feature extending along the long side of the package in the consumer non-preferred position, the resealable feature including a resealable tape 21 adhered to the package film bottom layer through a slot or window. The ends of the package are heat sealed as at 22*a* and 22*b*, the bottom is sealed as at 22*c*, and a perforation line 23 is provided to tear open the package along the package side and outward of the tape 21.

FIG. 2 shows an isometric view of a package 24 according to the invention having heat sealed ends 25*a* and 25*b*, a longitudinally extending bottom seal 22*c*, a perforation line 26 for tearing off the end seal 25*a*, and the consumer preferred transversely extending resealable tape 27 overlying and sealing closed the slot 28 in the package film, a part of the slot 28 being seen in the showing of FIG. 3 in which the end seal 25*a* is shown being torn away along the perforation line 26. The slot 28 is slightly longer than the width of the finished package so that it extends beyond the width of the package film upper layer 30 and wraps around into the film bottom layer 31 for a short distance of about one eighth to one quarter of an inch. The tape 27 is longer than the slot 26 so that in the finished package it is turned under at its ends 27*a* onto the bottom layer 31 of the package and beyond the ends of the slot 28 to thereby insure that the package is sealed after the heat sealed end is removed.

FIG. 4 is an enlarged cross sectional view through the resealable closure of FIG. 3, package opening perforation 26, and package end seal 25*a* as would be seen when viewed along the line 4—4 on FIG. 3. Also shown in FIG. 4 is the adhesive 29 which coats the underside of the tape 27, sealing the tape to the upper film layer 30 of the package 24 on opposite sides and ends of the slot 28 and to the bottom film layer 31 of the package through the slot 28 and at the turned under ends 27*a*.

FIG. 5 shows the formation of the heat sealed end 25*a* of one package and end 25*b* of the adjacent package by vertical actuation of the heated dies 32*a*/32*b* and 33*a*/33*b* respectively, formation of the perforation line 26 by the perforating blade 34, and the position for severing of the adjacent packages by the cutter 35. FIG. 6 shows the adjacent packages severed, the heat sealed end 25*a* separated from the right hand package at the perforation line 26, and the upper and bottom film layers 30 and 31 of the package 24 partly opened with the adhesive of the upper film layer released from the bottom film layer 31. The structure of FIG. 5 is also seen in FIG. 11 performing the final step in the illustrated packaging process in which products 36 to be packaged are fed into a standard packaging machine 37 together with pre-prepared composite packaging film 38 from a roll 39, the film roll 39 being produced by a converter apparatus as shown in FIGS. 7 through 10 to which reference should now be made.

FIG. 7 is a side diagrammatic view of the converter apparatus according to the invention showing the stages of formation of the composite film from start to finish at take-up roll 39. The various steps of the sequence of operations are controlled by sensors and servo motors which send and receive control signals to a computer 40 via signal lines 40*a* through 40*i*. The general sequence of operations for producing the composite package film begins with spooling base film 41 off of a supply roll 42 by passing it through the drive rollers 43 and around a series of film positioning rollers 44 to a slotting station. The film 41 is provided with a registration eye mark for each package length of the film, an eye mark sensor 41*a* located upstream of the slotter initiating the slotter cycle on detection of an eye mark to ensure that the slot cut occurs in registration with the eye mark. At the slotting station the slot 28 is cut into the base film 41 by a synchronously counter rotating pair of conventional male and female roller dies 45 and 46 respectively, the slotted-out piece of film being vacuum retained on the female die 46 and then air pressure released and vacuum removed for disposal by the vacuum tube device 47, described in more detail as follows.

The female slotter die 46 supports the film 41 during the slotting operation and also provides the means to remove the piece of scrap film that results from producing the slot. The scrap piece is captured by the die 46 by pulling a vacuum through holes in the die's perimeter in a manner similar to that to be described subsequently in connection with the operation of the tape slitter part of the apparatus. The vacuum is turned on approximately 20 degrees before the die 46 contacts the film 41 and holds the scrap piece against the die, pulling it free from the film as the die rotates away from the film. After the die 46 rotates approximately 185 degrees from the slotting position, the vacuum is switched off. At approximately 180 degrees from the slotting position, air pressure is turned on through the same holes in the die. This causes the scrap piece of film to be ejected into the vacuum receptacle 47. Both vacuum and pressure to the die 46 are provided through solenoid valves controlled by the computer 40 and are connected to the die through a rotary union mounted on the die's hollow shaft. Timing is independently adjustable for the on and off states of the vacuum and pressure solenoid valves.

The servo motor driven slotter roller dies 45 and 46 match film speed at all times that the slot cutting dies are in contact with the film. For the rest of the cycle, when they are out of contact with the film, their rotational velocity can be adjusted slightly faster or slightly slower than film velocity in order for the cutting dies to be in position for the next cutting cycle with minimum change in speed. Correction positioning is servo controlled by computer 40 and starts immediately after the slotter dies disengage from contact with the film to allow for major registration corrections.

From the slotting station the film moves to a tape slitting station where a linearly reciprocable slitter device 48 slits what becomes the resealable tape strip 27 from a web of adhesively coated tape delivered from a supply roll 49. The general sequence of this operation is as follows. The adhesively coated tape is pulled from the roll 49 to the slitter 48 by drive and pinch rollers 50 and 51 where it wraps partially around a vacuum roller 52 prior to slitting. The then slit-off tape strip 27 is retained on the vacuum roller 52 and pressure applied by the vacuum roller 52 and pressure roller 53 to the base film 41 in registry with and closing the slot 28, thereby forming the composite packaging film 38. The composite tape is pulled along by a servo controlled encoder drive roller 54 and pinch roller 55, the tape being wound into a supply roll 39 for subsequent use with the packaging machinery. The encoder drive roller 54 continuously generates timing signals to the computer 40, which in response controls servo motors that time the base film slotting, and the slitting and applying of the resealable tape to the base film. Alternatively to spooling the composite film into rolls 39, by matching production speeds of the converter and packaging machine, the composite film 38 may be routed directly into the packaging machine without intermediate spooling. A more detailed understanding of the tape slitting and applying operations will be had from referring to FIGS. 8 to 10, and particularly to FIGS. 9 and 10.

After detection of an eye mark by the sensor 41*a*, an encoder count in the computer 40 starts the cycle of the tape drum 52. This count is adjustable to compensate for the mounting location of the eye mark sensor 41*a* and for pitch trend variation of the eye marks. The tape drum 52, holding a cut tape strip 27, is accelerated by servo motor 61 to match the velocity of the film 41. Registration of the tape strip 27 held on the tape drum 52 with the slot 26 in the film 41 occurs after the tape drum 52 has matched the film speed. The tape drum 52 then applies the previously cut off piece of pressure sensitive tape 27 onto the film 41 such that the tape uniformly covers the slot 26 in the film. This is accomplished by ensuring that the tape is applied in proper indexed relationship to the eye mark on the film. Synchronization of both film velocity and the tape-strip-to-slot registrability is accomplished prior to the tape coming into contact with the film.

The tape drive roll 50 is normally stopped. A computer encoder count, after detection of an eye mark by the sensor 41*a*, starts the tape drive roll cycle, and is the same count that is used to initiate start of the tape drum 52 cycle. As the tape drive roll 50 feeds tape 56 from the roll 49 under the control of computer controlled servo motor 50*a*, the tape 56 is caused to wrap around the tape drum 52 as the tape drum rotates against the non-sticky side of the tape 56. This is accomplished by pulling a vacuum through rows of holes 57 in the perimeter of the tape drum 52. The tape drum 52 advances faster than the tape drive roll 50 feeds tape, causing slippage between the tape drum and the tape, and thereby preventing the tape from buckling by keeping the tape under tension. This also assures that the tape 56 is pulled free from the tape drive roll 50 rather than sticking to this roll and wrapping around it as it rotates. For the same reasons, the velocity of the tape drive roll 50 is at all times less than that of the tape drum 52 throughout the tape drum cycle, and stops feeding before the tape drum finishes its cycle. The tape drive roll 50 rotates approximately 40 degrees while the tape drum 52 rotates 180 degrees.

A tape strip eye mark sensor 58 is located radially to the tape drive roll 50 to detect an eye mark at each tape strip width on the tape 56 as the tape rolls around the tape drive roll 50. The tape drive roll 50 is stoped after a time count generated by detection of a tape strip eye mark. This compensates for location of the tape strip eye mark sensor 58 and provides fine tuning capability to ensure the desired point in the graphics on the tape is exactly in line with the tape cut knife 59 of the slitter device 48. If, for example, the eye marks on the tape are at a ⅞ inch pitch, the tape drive roll 50 will feed ⅞ inches of tape during each cycle. After the tape drive roll stops, the tape drum 52 continues rotating until it stops in one of its two home positions.

The tape drum 52 is provided with a pair of diametrically oppositely located slots 60 which provide clearance for the tape cut knife blade 59 that cuts off pieces of tape 27. The slots 60 are spaced 180 degrees apart so that the drum only has to travel 180 degrees instead of 360 degrees per cycle. A flag signal is generated for each 180 degrees of rotation of the tape drum, so that the servo motor 61 sees home positions at every 180 degrees, and thereby complete its cycle at both 180 and 360 degrees.

Vacuum is supplied to the tape drum vacuum holes 57 through the tape drum hollow central shaft 62 and vacuum union 63 from a vacuum source computer controlled by vacuum solenoid 64. The vacuum is applied to the tape 56 and cut off tape strip 27 through the half of the vacuum holes 57 that are at any given time positioned between eight o'clock and one o'clock on the drum 52. The other half of the vacuum holes, which are those open to atmosphere, are blocked off by a fixed position seal 65. Vacuum is thereby progressively turned on to the rows of vacuum holes 57 in the perimeter of the rotating tape drum as the incoming tape film 56 covers these holes, and is shut off from the holes as the tape strip 27 approaches the pressure roller 53. Accordingly, the vacuum holds the tape 56 in place while the tape strip 27 is being cut, and then is progressively turned off as the tape strip 27 is applied to the film.

Figure 10:
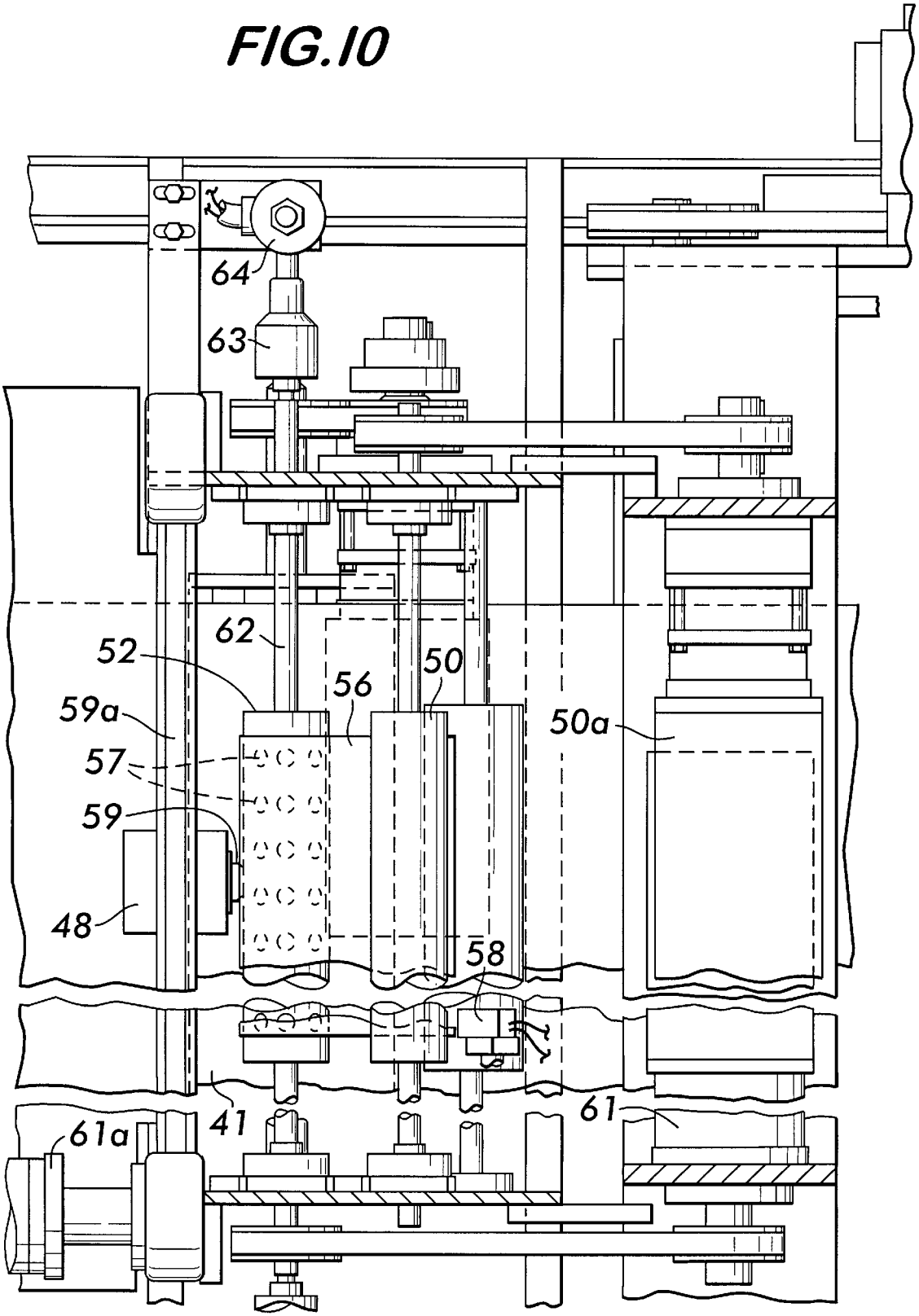
FIG. 10 is a plan view of FIG. 9 with some of the upper parts removed for clarity.
Figure 11:
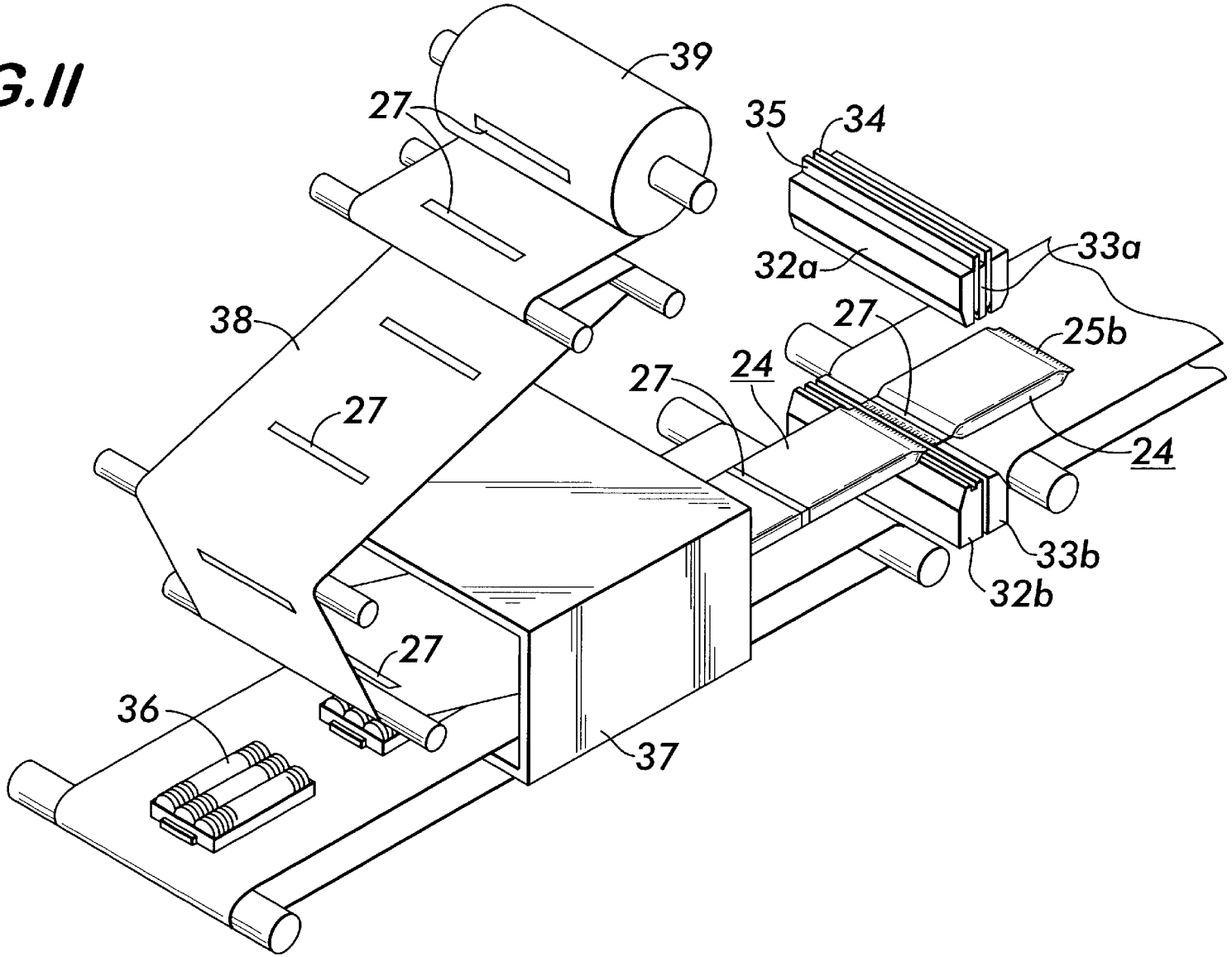
FIG. 11 is an isometric diagrammatic illustration of one form of apparatus for formation of separate packages according to the invention.

As best seen in FIG. 10, the tape cut knife blade 59 is reciprocating carried by a belt 59*a* driven under control of servo motor 61*a*, and is shifted along a linear axis to sever each tape strip 27 from the tape film 56, having stop positions just beyond both edges of the tape film. When the tape drive roll 50 has completed feeding the amount of tape corresponding to one tape strip width and its motion has stopped, the tape drum 52 has stopped in either of its home positions so as to align the knife blade 59 with one of the two slots 60 in the tape drum The knife blade 59 then moves full width across the tape film 56 and stops at its other position. When the tape drum 52 reaches its next home position after feeding the next strip width of tape, the tape cut knife returns to its previous position and cuts off that next strip.

The film pressure drum 53 cycle is initiated by an encoder count after film 41 eye mark detection by the eye mark sensor 41*a*. The pressure drum 53 rotates continuously at any time that film 41 is being fed and backs up the film 41 at the point in the cycle where the piece of pressure sensitive tape 27 is applied to the film, pressing the film/tape laminate against the tape drum 52 and thereby supplying the pressure required for the pressure sensitive tape strip 27 to be securely fastened to the film 41. The film back-up is provided by two resilient pressure pads 66 spaced 180 degrees apart on the circumference of the pressure drum 53. The surface velocity of these pads matches the velocity of the film 41 at all times that they are in contact with the film. For the rest of the cycle, when the pressure drum is not pressing the film against the tape drum 52, the pressure pads velocity can be slightly faster or slightly slower than film 41 velocity in order to get into position for the next pressure cycle. As soon as a pressure pad 66 is no longer in contact with the tape drum 52, position correction starts in order to provide major registration corrections with minimum change in speed. During this interval the film 41 rides around the pressure roller 53 on the rollers 67.

Each pressure pad 66 is formed with a radially inwardly extending recess 68 which rotates into registry with the slots 26 in the film during the tape strip application part of the cycle. As the pressure sensitive tape 27 is applied over the slot 26 in the film 41, the pressure pads 66 are pressed only against the film around the perimeter of slot 26 so that the pads do not press against the pressure sensitive tape 27 that is exposed through the slot 26 in the film 41. The various pressure drum positioning are controlled by computer control of servo motor 69, which accomplishes tape strip to slot registration by ensuring that the recesses 68 in the pressure drum 53 are in registration with the film 41 eye marks.

Having now described the invention in connection with a particularly illustrated embodiment thereof, it will be understood that modifications and variations of the invention may now occur from time to time to those normally skilled in the art without departing from the essential scope or spirit of the invention, and accordingly it is intended to claim the invention both broadly and specifically as indicated in the appended claims.

What is claimed is:

1. A flexible package comprising in combination, a) a closed package body comprising at least one thickness of flexible material, said package body having upper and bottom layers and an interior space for containing a packaged product, b) a pair of non-adjacent package body end seals extending widthwise of said package body and being separated by the length of said package body, c) manually operable means effective when operated for opening at least a portion of one of said end seals, and d) a repeatable openable and resealable package closure positioned between said openable end seal and the said interior space of said package body, said package closure extending the full width of the package and comprising, 1) a slot extending fully widthwise through one of said upper and bottom layers of flexible material and also extending for a short distance at opposite ends around into the other of said upper and bottom layers of flexible material, and 2) an adhesively coated tape completely covering said slot, said tape being adhered to the outer surface of the said fully slotted layer of flexible material and around onto the said other of said upper and bottom layers of flexible material beyond the ends of said slot, said adhesively coated tape completely closing said slot and adhering said upper and bottom layers of flexible material together throughout the complete width of the said package.

2. A package as set forth in claim 1 wherein said manually operable means for opening one of said end seals is a line of manually rupturable perforations which when ruptured separate the said end seal from the package body throughout the extent of the rupture, and wherein at least one of said end seals is a heat seal.

* * * * *